US010294786B2

(12) United States Patent
Weber et al.

(10) Patent No.: US 10,294,786 B2
(45) Date of Patent: May 21, 2019

(54) ROTATABLE CUTTING TOOL WITH CUTTING INSERT AND BOLSTER

(71) Applicant: Kennametal Inc., Latrobe, PA (US)

(72) Inventors: Luke A. Weber, Hollidaysburg, PA (US); Brandon J. Kenno, Windber, PA (US); Nicholas J. Paros, Johnstown, PA (US)

(73) Assignee: KENNAMETAL INC., Latrobe, PA (US)

( * ) Notice: Subject to any disclaimer, the term of this patent is extended or adjusted under 35 U.S.C. 154(b) by 167 days.

(21) Appl. No.: 15/163,433

(22) Filed: May 24, 2016

(65) Prior Publication Data

US 2017/0342831 A1 Nov. 30, 2017

(51) Int. Cl.

| | |
|---|---|
| ***E21C 35/183*** | (2006.01) |
| ***E21C 35/19*** | (2006.01) |
| *E21C 35/18* | (2006.01) |

(52) U.S. Cl.

CPC ..... *E21C 35/19* (2013.01); *E21C 35/183* (2013.01); *E21C 2035/1806* (2013.01); *E21C 2035/1813* (2013.01); *E21C 2035/1816* (2013.01)

(58) Field of Classification Search

CPC ..... E21C 2035/1803; E21C 2035/1806; E21C 2035/1816; E21C 35/183; E21C 35/18; E21C 2035/1809; E21C 2035/1813; E21B 10/46–10/58

See application file for complete search history.

(56) References Cited

U.S. PATENT DOCUMENTS

| | | | | |
|---|---|---|---|---|
| 3,397,012 A * | 8/1968 | Krekeler | ..... | E21C 35/1933 172/713 |
| 4,397,362 A | 8/1983 | Dice | | |
| 4,850,649 A | 7/1989 | Beach et al. | | |
| 4,886,710 A | 12/1989 | Greenfield | | |
| 4,944,559 A * | 7/1990 | Sionnet | ..... | E21C 35/183 299/105 |
| 5,141,289 A | 8/1992 | Stiffler | | |

(Continued)

OTHER PUBLICATIONS

Jun. 15, 2017 Office action (3 months) 1.

(Continued)

*Primary Examiner* — Janine M Kreck
*Assistant Examiner* — Michael A Goodwin
(74) *Attorney, Agent, or Firm* — Matthew S. Bedsole

(57) ABSTRACT

A rotatable cutting tool (10) includes a cutting tool body (12) having an axial forward end (14) and an axial rearward end (16). A bolster (46) at least partially received in a head portion (22) and includes a convex-shaped head portion (56) with a socket (20), a collar portion (58) and a tapered shank portion (60). The socket (20) is formed with a substantially planar side wall (20*a*), a bottom wall (20*b*), and a radius blend (20*c*). A hard tip or cutting insert (18) is at least partially received in the socket (20) of the bolster (46) and includes a convex-shaped conical head portion (72), a collar portion (74) and an axially-rearward portion (76) that generally conforms to the geometry of the socket (20) of the bolster (46). Between about sixty percent (60%) and about ninety percent (90%) of the cutting insert (18) is received in the socket (20) of the bolster (46), thereby reducing forces and stresses transmitted to the cutting tool (10) during a machining operation.

16 Claims, 6 Drawing Sheets

(56) References Cited

U.S. PATENT DOCUMENTS 5,161,627 A * 11/1992 Burkett ..... E21B 10/567 299/111
5,324,098 A * 6/1994 Massa ..... E21C 35/183 299/111
5,421,423 A * 6/1995 Huffstutler ..... E21B 10/16 175/374
D387,072 S 12/1997 Ojanen
5,702,160 A 12/1997 Levankovskii
6,375,272 B1 * 4/2002 Ojanen ..... E21C 35/183 299/110
6,644,755 B1 11/2003 Kammerer
D490,286 S 5/2004 Simons
7,396,086 B1 * 7/2008 Hall ..... E21C 35/183 299/111
7,419,224 B2 9/2008 Hall
D627,804 S 11/2010 Fader
D627,808 S 11/2010 Kammerer
D627,809 S 11/2010 Kammerer
D636,797 S 4/2011 Kammerer
D637,213 S 5/2011 Kammerer
8,028,774 B2 * 10/2011 Hall ..... E21B 10/5673 175/425
8,250,786 B2 8/2012 Hall
D707,269 S 6/2014 Meier
D707,270 S 6/2014 Meier
8,931,854 B2 1/2015 Hall
2003/0209366 A1 * 11/2003 McAlvain ..... E21C 35/183 299/113
2004/0026132 A1 2/2004 Hall
2004/0065484 A1 * 4/2004 McAlvain ..... E21C 35/183 175/434
2007/0040442 A1 2/2007 Weaver
2008/0315667 A1 * 12/2008 Hall ..... E21C 35/183 299/113
2010/0194177 A1 8/2010 Wohrstein et al.
2010/0206641 A1 8/2010 Hall et al.
2010/0263939 A1 10/2010 Hall et al.
2010/0295360 A1 11/2010 Kramer et al.
2011/0080037 A1 4/2011 Kelly et al.
2011/0175430 A1 * 7/2011 Heiderich ..... B23P 11/027 299/105
2012/0049608 A1 3/2012 Ritchey et al.
2012/0068528 A1 * 3/2012 Grief ..... E21C 35/183 299/113
2012/0146390 A1 6/2012 Flynn et al.
2012/0242136 A1 * 9/2012 Ojanen ..... E21C 35/18 299/105
2013/0207445 A1 * 8/2013 Bell ..... E21C 35/18 299/105
2014/0054951 A1 * 2/2014 Bookhamer ..... E21C 35/183 299/113
2014/0262541 A1 * 9/2014 Parsana ..... E21B 10/567 175/428
2015/0198040 A1 * 7/2015 Voitic ..... B23K 1/0008 299/105
2017/0043452 A1 * 2/2017 Daniels ..... B24D 18/00
2017/0342831 A1 11/2017 Weber

OTHER PUBLICATIONS www.kennametal.com/en/products/17442915/100028050.html.
www.kennametal.com/hi/products/18934469/surface-mining/cutting-tools.html.
http://srpicks.com/productlists.asp?SortID=103&parentid=103.
Oct. 16, 2017 Final Office Action.

* cited by examiner

ROTATABLE CUTTING TOOL WITH CUTTING INSERT AND BOLSTER

FIELD OF THE INVENTION

The invention pertains to a rotatable cutting tool that is useful for the impingement of earth strata such as, for example, asphaltic roadway material, coal deposits, mineral formations and the like. More specifically, the invention pertains to a rotatable cutting tool with a cutting tip and bolster that is useful for the impingement of earth strata that reduces stresses and forces transmitted to the cutting tool during a machining operation, thereby improving performance characteristics for the rotatable cutting tool.

BACKGROUND OF THE INVENTION

Rotatable cutting tools have been used to impinge earth strata, such as, for example, asphaltic roadway material or ore bearing or coal bearing earth formations, or the like. Generally speaking, these kinds of rotatable cutting tools have an elongate cutting tool body typically made from steel and a hard tip (or cutting insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder or, in the alternative, in the bore of a sleeve that is in turn held in the bore of a holder.

The holder is affixed to a driven member such as, for example, a driven drum of a road planing machine. In some designs, the driven member (e.g., drum) carries hundreds of holders, wherein each holder carries a rotatable cutting tool. Hence, the driven member may carry hundreds of rotatable cutting tools. The driven member is driven (e.g., rotated) in such a fashion so that the hard tip of each one of the rotatable cutting tools impinges or impacts the earth strata (e.g., asphaltic roadway material), thereby fracturing and breaking up the material into debris.

As can be appreciated, during operation the rotatable cutting tool and the cutting insert are typically subjected to a variety of extreme cutting forces and stresses in an abrasive and erosive environment. The overall total length of the cutting insert, and in particular, the length that the cutting insert extends from the axial forward end of the cutting tool, determines the amount of forces and stresses that are transmitted to the cutting tool during operation. In other words, the more the cutting insert extends from the cutting tool, the larger the forces and stresses that will be generated, which may result in tool failure.

SUMMARY OF THE INVENTION

The invention solves the problem of the transmission of excessive forces and stresses to the cutting tool by providing a cutting insert that is at least partially received in a socket of a bolster, wherein a relatively large percentage of the cutting insert is received in the socket of the bolster as compared to conventional cutting inserts.

In one aspect of the invention, a rotatable cutting tool includes a cutting tool body having an axial forward end and an axial rearward end. A head portion is axially rearward of the axial forward end, a collar portion is axially rearward of the head portion, and a shank portion is axially rearward of the collar portion and axially forward of the axial rearward end. A bolster is at least partially received in the head portion. The bolster includes a convex-shaped head portion formed with a radius, R1, a collar portion and a tapered shank portion. The convex-shaped head portion includes a socket formed with a side wall, a bottom wall, and a radius blend formed with a radius, R2, extending between the side wall and the bottom wall. A cutting insert is at least partially received in the socket of the bolster. The cutting insert includes a convex-shaped conical head portion, a collar portion and an axially-rearward portion. The axially-rearward portion includes a forward cylindrical section proximate the collar portion, a radius blend formed with a radius, R5, and a rearward section, wherein between about sixty percent and about ninety percent of the cutting insert is received in the socket of the bolster, thereby reducing forces and stresses transmitted to the cutting tool during a machining operation.

In another aspect of the invention, a cutting insert (18) comprises a convex-shaped conical head portion having a length, L1, a collar portion having a length, L2, and an axially-rearward portion having a length, L3. The axially-rearward portion includes a forward cylindrical section proximate the collar portion, a radius blend formed with a radius, R5, and a rearward section, wherein the length, L2 of the collar portion and the length, L3, of the axially-rearward portion is between about sixty percent (60%) and about ninety percent (90%) of the length, L1, of the head portion.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

DETAILED DESCRIPTION OF THE INVENTION

Figure 1:
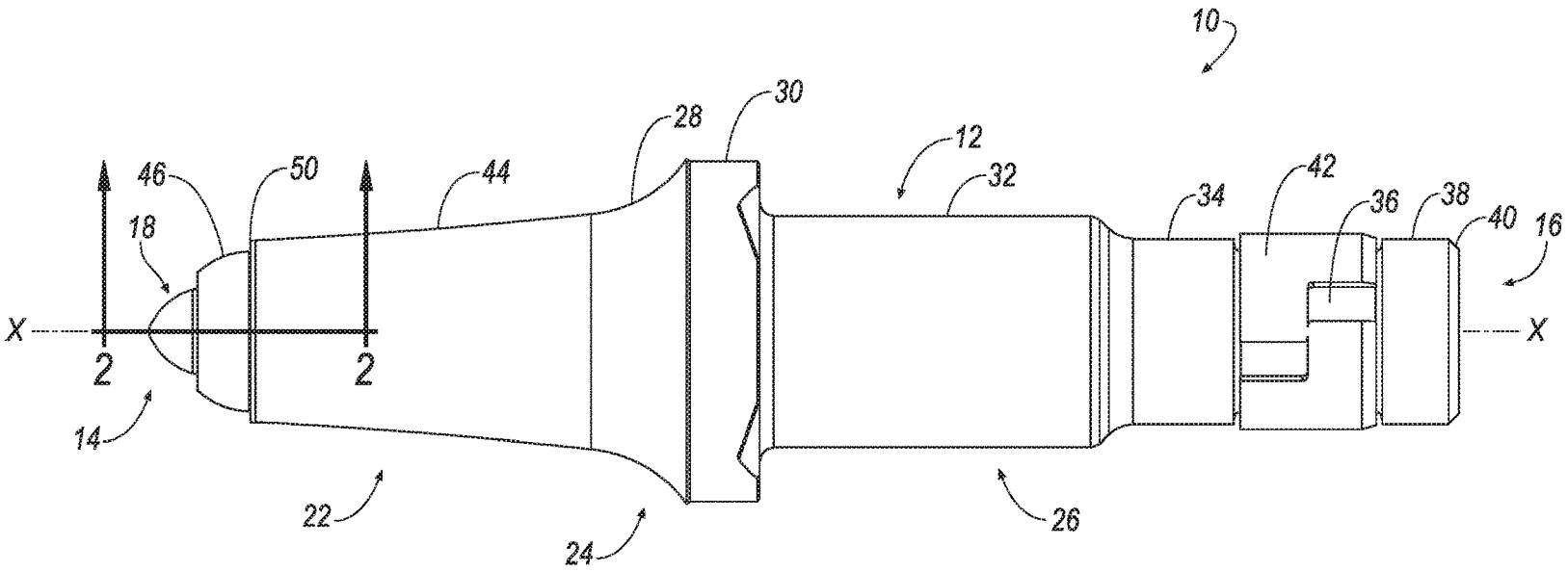
FIG. 1 is a side view of a rotary cutting tool with a cutting insert and a bolster according to an embodiment of the invention.
Figure 2:
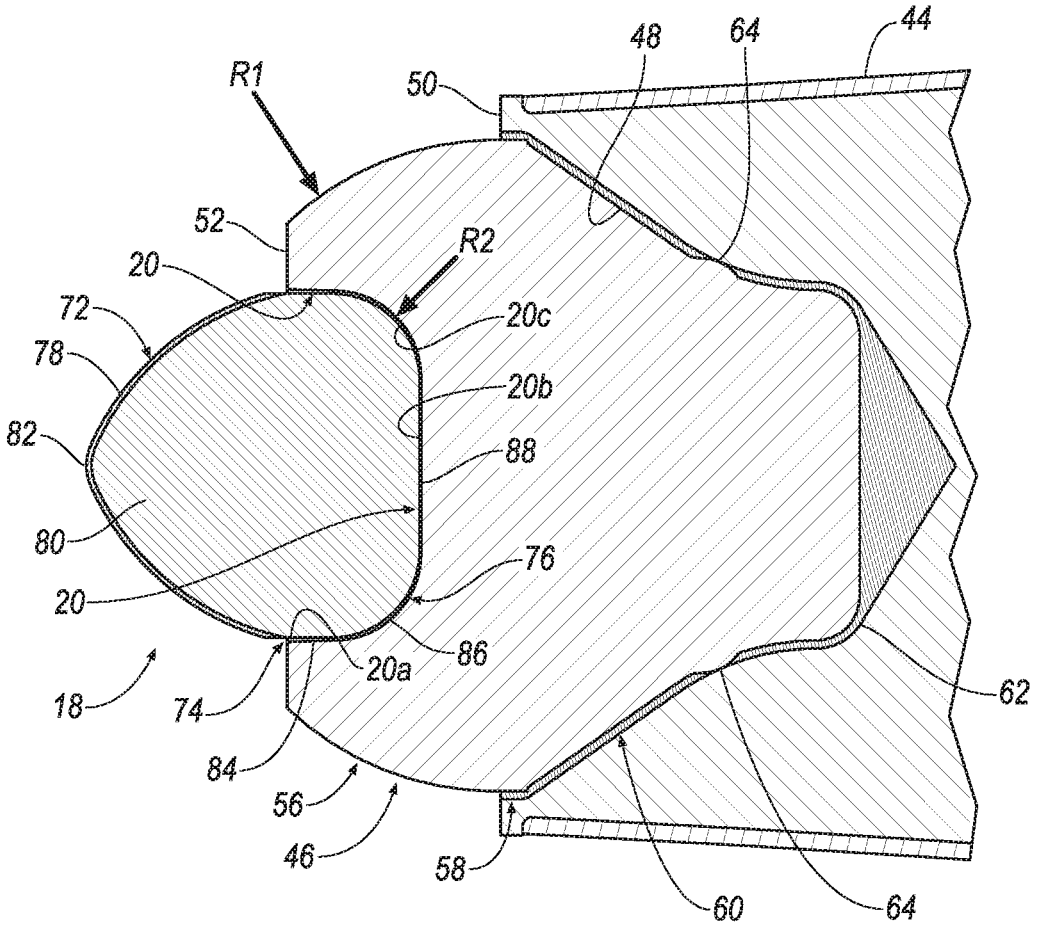
FIG. 2 is a cross-sectional view of the cutting insert, bolster and head portion of the rotary cutting tool taken along line 2-2 of FIG. 1.

Referring to the drawings wherein like reference characters designate like elements, a rotatable cutting tool 10 is generally shown in FIGS. 1 and 2 according to an aspect of the invention. The rotatable cutting tool 10 comprises an elongate cutting tool body, generally designated as 12. The cutting tool body 12 is typically made of steel, such as Mn—B steel alloy, and the like. The cutting tool body 12 has an axial forward end 14 and an axial rearward end 16. A hard tip or cutting insert 18 is affixed (such as by brazing or the like) into a socket 20 in the axial forward end 14 of the cutting tool body 12.

The cutting tool body 12 is divided into three principal portions; namely, a head portion 22, a collar portion 24 and a shank portion 26. The most axial forward portion is the head portion 22 that begins at the axial forward end 14 and extends along longitudinal axis X-X in the axial rearward direction. The mediate portion is the collar portion 24 that begins at the juncture with the head portion 22 and extends along the longitudinal axis X-X in the axial rearward direction. The collar portion 24 comprises a tapered neck section 28 followed by a cylindrical collar section 30.

The most axial rearward portion is the shank portion 26 that begins at the juncture with the collar portion 24 and extends along the longitudinal axis X-X in the axial rearward direction. The shank portion 26 comprises a forward cylindrical tail section 32, followed by a mid-section 34, followed by a retainer groove 36, followed by a rearward cylindrical tail section 38 and terminating in a beveled section 40. As is known by those skilled in the art, the shank portion 26 is the portion of the cutting tool body 22 that carries a retainer 42. The retainer 42 rotatably retains the rotatable cutting tool 10 in the bore of a tool holder (not shown) or the bore of the sleeve carried by a holder.

Still referring to FIGS. 1 and 2, the head portion 22 includes a base portion 44 that is affixed to the collar portion 24. As illustrated in FIGS. 1 and 2, the base portion 44 of the head portion 22 is formed with a pocket, shown generally at 48. In one aspect, the pocket 48 extends axially along axis X-X from an axial forward end 50 of the base portion 44 rearwardly toward the collar portion 24.

A bolster 46 is at least partially received in the pocket 48 of the base portion 44. The bolster 46 is made of a suitable material, such as cemented metal carbide material comprising about 1 to 40 percent concentration of cobalt by weight, preferably 5 to 10 percent. In one aspect of the invention, the cutting insert 18 is affixed to the bolster 46.

Referring now to FIGS. 3-7, the bolster 46 is shown according to an embodiment of the invention. The bolster 46 has an axial forward end 52 and an axial rearward end 54. The bolster 46 is divided into three principal portions; namely, a convex-shaped head portion 56, a collar portion 58 and a tapered shank portion 60 that terminates in a beveled section 62. The most axial forward portion is the convex-shaped head portion 56 that begins at the axial forward end 52 and extends along longitudinal axis Y-Y in the axial rearward direction. In one embodiment, the convex head portion 56 is formed with a radius, R1, of about 0.54 in (13.8 mm). The mediate portion is the collar portion 58 that begins at the juncture with the head portion 56 and extends along the longitudinal axis Y-Y in the axial rearward direction to the tapered shank portion 60. In one embodiment, a portion the tapered shank portion 60 proximate the collar portion 58 is formed with an angle, A1, of about thirty-five (35) degrees with respect to the longitudinal axis Y-Y.

Figure 5:
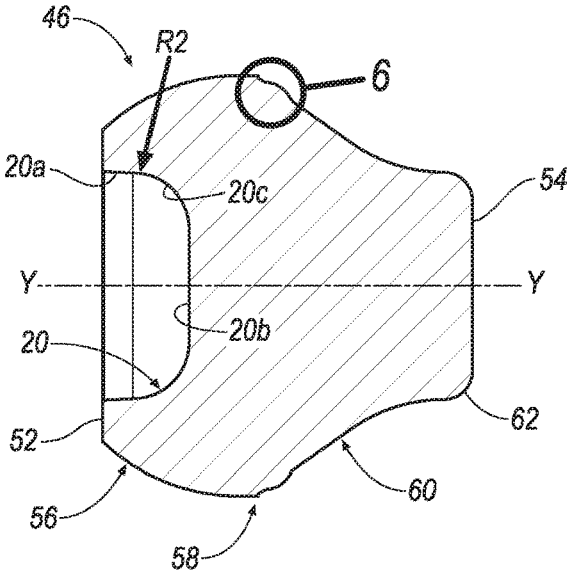
FIG. 5 is a cross-sectional view of the bolster taken along line 5-5 of FIG. 3.

As shown in FIG. 5, the convex-shaped head portion 56 of the bolster 46 includes the socket 20 for receiving the cutting insert 18. The socket 20 is formed with a substantially planar side wall 20*a*, a substantially planar bottom wall 20*b*, and a radius blend 20*c* extending between the side wall 20*a* and the bottom wall 20*b*. In one embodiment, the radius blend 20*c* is formed with a radius, R2, of about 0.157 in (4.00 mm).

Figure 4:
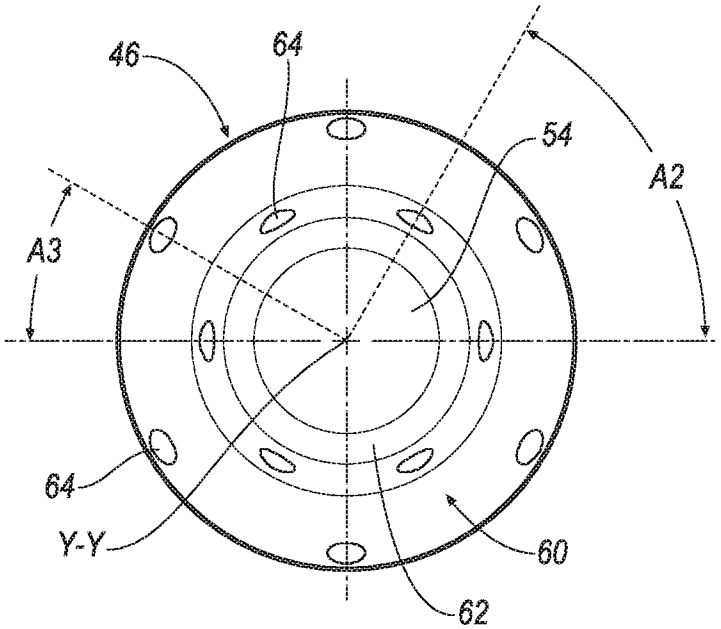
FIG. 4 is a bottom view of the bolster of FIG. 3.
Figure 3:
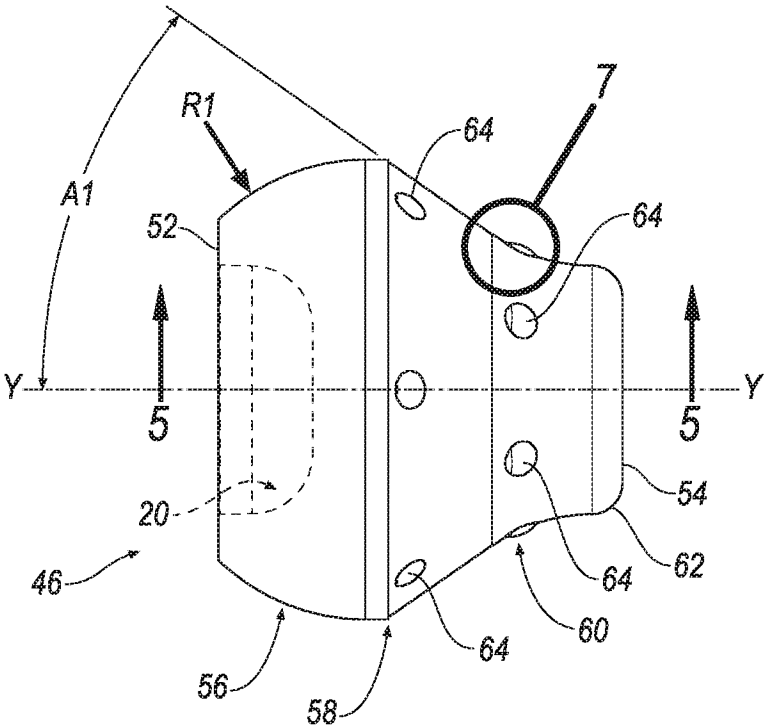
FIG. 3 is a side view of the bolster according to an embodiment of the invention.

Referring now to FIGS. 3 and 4, the bolster 46 is movably connected to the base portion 44 when initially installed within the pocket 48 of the head portion 22. This movable connection is provided by a plurality of dimples 64 formed in the tapered shank portion 60 that engage the pocket 48 of the base portion 44 of the head portion 22. As shown in FIG. 4, the dimples 64 lie in two circumferential rows about the tapered shank portion 60, each row having six (6) equidistantly-spaced dimples 64 at an angle, A2, of about sixty (60) degrees such that the dimples 64 in one row is circumferentially spaced from the dimples 64 in the other row by an angle, A3, of about thirty (30) degrees.

Figure 6:
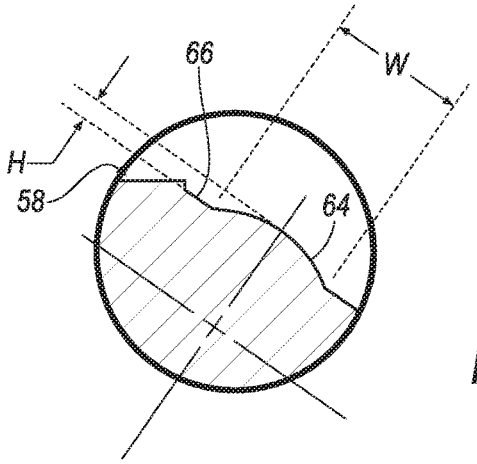
FIG. 6 is an enlarged cross-sectional view of a dimple of the tapered shank portion of the bolster.
Figure 7:
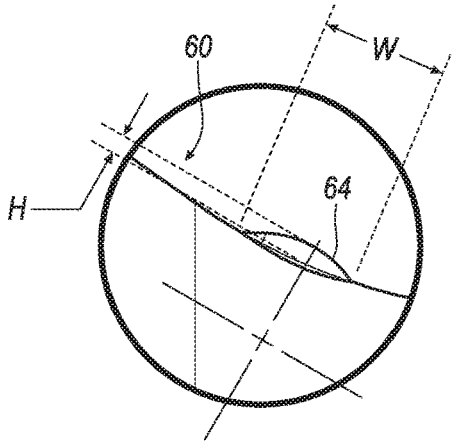
FIG. 7 is an enlarged view of the dimple of the tapered shank portion of the bolster.

As shown in FIGS. 6 and 7, each dimple 64 is substantially identical and have a semi-spherical shape with a height, H, of about 0.015 in (0.37 mm) and a width, W, of about 0.093 in (2.36 mm). After positioned at the desired position within the pocket 48, the bolster 46 is then fixedly attached to the pocket 48 by brazing, and the like. In one embodiment, the bolster 46 is affixed to the pocket 48 by brazing at a location 66 formed between each dimple 64 and the collar portion 58, as shown in FIG. 6. It will be appreciated that other means for fixedly attaching the bolster 46 to the base portion 44 may be provided in accordance with the scope of the invention.

Figure 8:
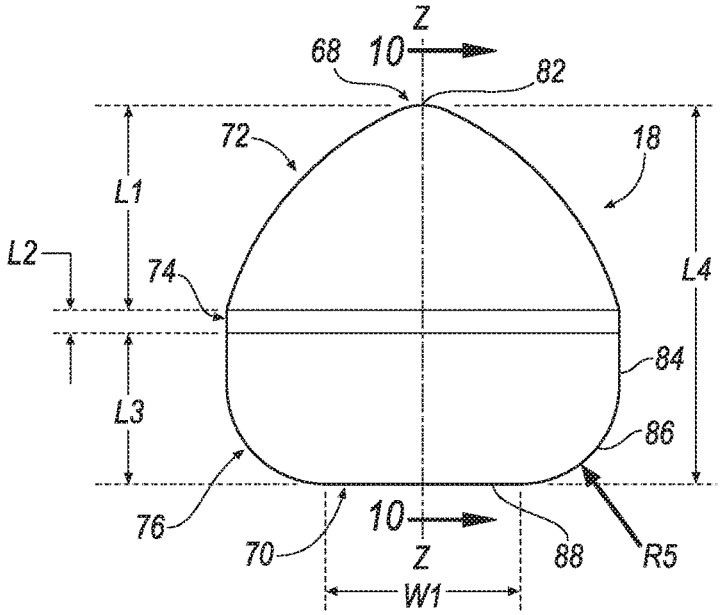
FIG. 8 is a side view of the cutting insert according to an embodiment of the invention.
Figure 9:
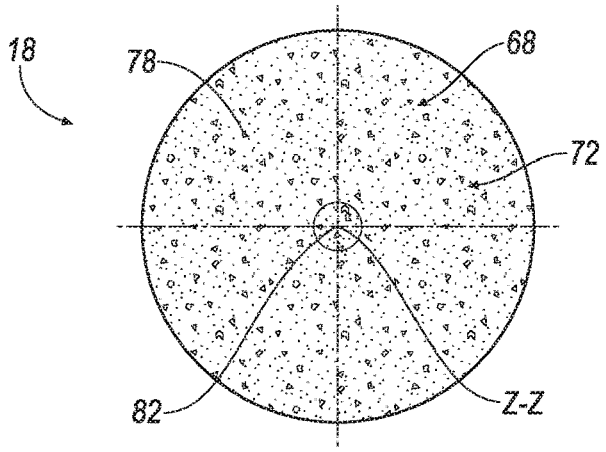
FIG. 9 is a top view of the cutting insert of FIG. 8.
Figure 10:
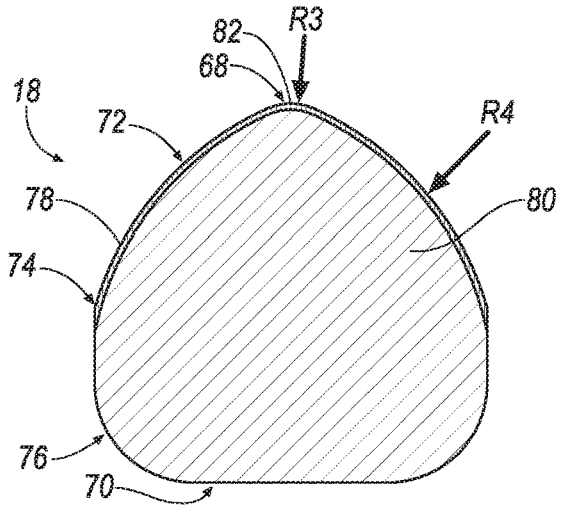
FIG. 10 is a cross-sectional view of the cutting insert taken along line 10-10 of FIG. 8.

Referring now to FIGS. 8-10, the hard tip or cutting insert 18 is shown according to an embodiment of the invention. The hard tip or cutting insert 18 has an axial forward end 68 and an axial rearward end 70. The cutting insert 18 is divided into three principal portions; namely, a convex-shaped conical head portion 72, a collar portion 74 and an axially-rearward portion 76 that terminates in a radius blend 86. The most axial forward portion is the convex-shaped head portion 72 that begins at the axial forward end 68 and extends along longitudinal axis Z-Z in the axial rearward direction. The mediate portion is the collar portion 74 that begins at the juncture with the head portion 72 and extends along the longitudinal axis Z-Z in the axial rearward direction to the axially-rearward portion 76.

As shown in FIG. 8, the axially-rearward portion 76 includes three sections: a forward cylindrical section 84 proximate the collar portion 74, a radius blend 86 formed with a radius, R5, and a substantially planar rearward section 88. In one embodiment, the radius, R5, is between about 0.14 in (3.556 mm) to about 0.18 in (4.572 mm). For example, the radius, R5, can be about 0.157 in (4.00 mm). It is noted that the radius, R5, of the radius blend 86 of the cutting insert 18 is approximately equal to the radius, R2, of the radius blend 20*c* of the socket 20. The substantially planar rearward section 88 has a width, W1, of about between about 0.21 in (5.334 mm) to about 0.41 in (10.414 mm). For example, the substantially planar rearward section 88 can have a width, W1, of about 0.31 in (7.88 mm). In cases where the substantially planar rearward section 88 is circular, then the width, W1, is substantially equal to the diameter of the rearward section 88. It is noted that the geometry of the planar rearward section 88 substantially conforms to the geometry of the bottom wall 20*b* of the socket 20.

In the illustrated embodiment, the rearward section 88 is substantially planar. However, it will be appreciated that the invention is not limited by the rearward section 88 being planar, and that the invention can be practiced with any desirable geometry, such as tapered, non-planar, and the like, so long as the geometry of the rearward section 88 generally conforms to the geometry of the bottom wall 20*b* of the socket 20 of the bolster 46.

The cutting insert 18 comprises a super hard material 78 bonded to a cemented metal carbide substrate 80. The super hard material may be bonded to the substrate through a high temperature, high pressure process. The super hard material 78 may comprise diamond, polycrystalline diamond (PCD), natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof. The super hard material 78 may have a thickness of at least 0.100 in (2.54 mm). As shown in FIG. 10, the super hard material 78 is bonded only to the head portion 72 and the collar portion 74 of the cutting insert 18.

In the illustrated embodiment, the head portion 72 of the cutting insert 18 has a substantially pointed geometry with an apex 82 having a radius, R3, of between about 0.050 in (1.27 mm) to about 0.125 in (3.175 mm). For example, the apex 82 may have a radius, R3, of about 0.090 in (2.40 mm). The head portion 72 is also formed with a radius, R4, of between about 0.25 in (6.35 mm) to about 0.75 in (19.05 mm). For example, the head portion 72 may be formed with a radius, R4, of about 0.50 in (12.7 mm).

As shown in FIG. 8, the head portion 72 can have a length, L1, of between about 0.30 in (76.2 mm) to about 0.35 in (88.9 mm). For example, the head portion 72 can have a length, L1, of about 0.325 in (8.27 mm). The collar portion 74 has a length, L2, of between about 0.03 in (0.762 mm) to about 0.045 in (1.143 mm). For example, the collar portion 74 can have a length of about 0.038 in (0.95 mm). The axially-rearward portion 76 can have a length, L3, of between about 0.22 in (5.588 mm) to about 0.26 in (6.604 mm). That is, the length, L3, of the axially-rearward portion 76 can be between about sixty percent (60%) and about ninety percent (90%) of the length, L1, of the head portion 72. In one embodiment, the length, L3, is about seventy-five percent (75%) of the length, L1, of the head portion 72. For example, the axially-rearward portion 76 can have a length, L3, of about 0.24 in (6.10 mm). Thus, the cutting insert 18 can have a total overall length, L4, of between about 0.55 in (13.97 mm) and about 0.655 in (16.637 mm). For example, the total overall length, L4 of the cutting insert 18 is about 0.603 in (15.32 mm).

Figure 11:
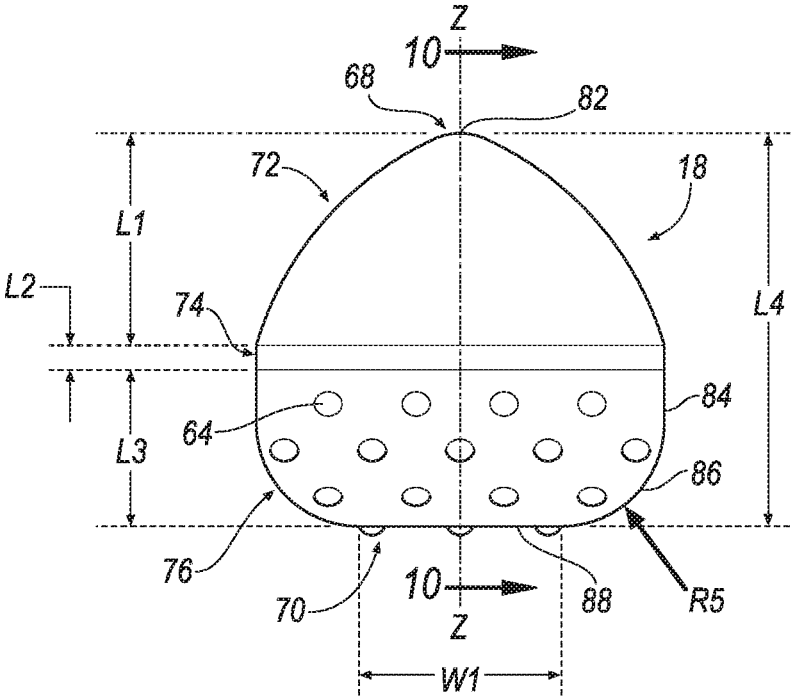
FIG. 11 is a side view of the cutting insert with dimples according to an alternative embodiment of the invention.

Referring now to FIG. 11, a cutting insert 18 is shown according to an alternative embodiment of the invention. In this embodiment, the cutting insert 18 is substantially identical to the cutting insert 18 shown in FIGS. 8-10, except the cutting insert 18 shown in FIG. 11 includes dimples 64 on the axially-rearward portion 76. The dimples 64 on the cutting insert 18 can be substantially identical to the dimples 64 on the bolster 46 and perform the same function when affixing the cutting insert 18 to the bolster 46 by brazing at a location 66 formed between each dimple 64 and the collar portion 74.

As mentioned above, the cutting insert 18 is affixed to the socket 20 of the bolster 46 by brazing, and the like. Because the geometry of the cutting insert 18 generally conforms to the geometry of the socket 20 of the bolster 46, the cutting insert 18 is affixed to the side wall 20*a* of the socket 20 with a tolerance of about 0.005 in (0.13 mm) and affixed to the bottom wall 20*b* of the socket 20 with a tolerance of about 0.003 in (0.08 mm). However, it will be appreciated that the geometry of the cutting insert 18 can vary depending upon the specific application, so long as the collar portion 74 and the axially-rearward portion 76 conforms to the geometry of the socket 20 of the bolster 46. For example, the bottom wall 20*b* of the socket 20 and the rearward section 88 of the cutting insert 18 can be non-planar, tapered, and the like.

As shown in FIG. 2, the collar portion 74 and the axially rearward portion 76 of the cutting insert 18 is disposed within the socket 20 of the bolster 46. In other words, only the head portion 72 of the cutting insert 18 extends from the axial forward end 52 of the bolster 46. Thus, between about sixty percent (60%) and about ninety percent (90%) of the cutting insert 18 is received in the socket 20 of the bolster 46. As a result, the geometry of the cutting insert 18 and the conforming geometry of the socket 20 of the bolster 46 is such that a relatively large percentage of the cutting insert 18 is received in the socket 20 of the bolster, thereby reducing the transmission of forces and stresses to the cutting tool 10 during a machining operation more effectively and reducing tool failure, as compared to conventional cutting tips with shanks that extend a greater distance from the axial forward end of the cutting tool.

The patents and publications referred to herein are hereby incorporated by reference.

Having described presently preferred embodiments the invention may be otherwise embodied within the scope of the appended claims.

What is claimed is:

1. A rotatable cutting tool having a longitudinal axis and defining an axial direction parallel to the longitudinal axis, comprising:

a cutting tool body, the cutting tool body having an axial forward end and an axial rearward end, a head portion axially rearward of the axial forward end, a collar portion axially rearward of the head portion, and a shank portion axially rearward of the collar portion and axially forward of the axial rearward end;

a bolster at least partially received in the head portion, the bolster including a convex-shaped head portion formed with a radius, R1, a collar portion and a tapered shank portion, the convex-shaped head portion including a socket formed with a side wall, a bottom wall, and a radius blend formed with a radius, R2, extending between the side wall and the bottom wall; and a cutting insert at least partially received in the socket of the bolster, the cutting insert including a convex-shaped conical head portion, a collar portion and an axially-rearward portion, the axially-rearward portion including a forward cylindrical section proximate the collar portion, a radius blend formed with a radius, R5, and a rearward section, wherein between sixty percent and ninety percent of the cutting insert is received in the socket of the bolster, thereby reducing forces and stresses transmitted to the cutting tool during a machining operation;

wherein the cutting insert comprises a super hard material bonded to a cemented metal carbide substrate;

wherein the super hard material is bonded only to the convex-shaped conical head portion and the collar portion of the cutting insert; and the collar portion is at least partially received within the socket of the bolster and the axially rearward portion of the cutting insert is received within the socket of the bolster.

2. The rotatable cutting tool according to claim 1, wherein the super hard material comprises diamond, polycrystalline diamond (PCD), natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof.

3. The rotatable cutting tool according to claim 1, wherein the head portion of the cutting insert has a pointed geometry with an apex having a radius, R3.

4. The rotatable cutting tool according to claim 1, wherein the head portion of the cutting insert is formed with a radius, R4.

5. The rotatable cutting tool according to claim 1, wherein the head portion has a length, L1, measured in the axial direction, the collar portion has a length, L2, measured in the axial direction, and the axially-rearward portion has a length, L3, measured in the axial direction.

6. The rotatable cutting tool according to claim 5, wherein the length, L3, of the axially-rearward portion is between sixty percent and ninety percent of the length, L1, of the head portion.

7. The rotatable cutting tool according to claim 1, wherein the bolster further includes a plurality of dimples formed in the tapered shank portion for engaging a pocket formed in a base portion of the head portion.

8. The rotatable cutting tool according to claim 7, wherein the plurality of dimples lie in two circumferential rows the tapered shank portion of the bolster.

9. The rotatable cutting tool according to claim 1, wherein the cutting insert is affixed to the side wall of the socket with a tolerance of 0.005 in (0.13 mm) and affixed to the bottom wall of the socket with a tolerance of 0.003 in (0.08 mm).

10. The rotatable cutting tool according to claim 1, wherein the radius, R2, is equal to the radius, R5.

11. The rotatable cutting tool according to claim 1, wherein the bottom wall of the socket and the rearward section of the cutting insert are planar.

12. A cutting insert for being at least partially received in a socket of a bolster of a rotatable cutting tool, the cutting insert having a longitudinal axis defining an axial direction, the cutting insert comprising a convex-shaped conical head portion having a length, L1, measured in the axial direction, a collar portion having a length, L2, measured in the axial direction, and an axially-rearward portion having a length, L3, measured in the axial direction, the axially-rearward portion including a forward cylindrical section proximate the collar portion, a radius blend formed with a radius, R5, and a rearward section, wherein a total combined length of the length, L2 of the collar portion and the length, L3, of the axially-rearward portion is between sixty percent (60%) and ninety percent (90%) of the length, L1, of the head portion, wherein the cutting insert comprises a super hard material bonded to a cemented metal carbide substrate; and wherein the super hard material is bonded only to the convex-shaped conical head portion and the collar portion of the cutting insert.

13. The cutting insert according to claim 12, wherein the super hard material comprises diamond, polycrystalline diamond (PCD), natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, non-metal catalyzed diamond, or combinations thereof.

14. The cutting insert according to claim 12, wherein the head portion has a pointed geometry with an apex having a radius, R3.

15. The cutting insert according to claim 12, wherein the head portion is formed with a radius, R4.

16. The cutting insert according to claim 12, wherein the rearward section is planar.

* * * * *